US006758643B1

(12) United States Patent
Hsieh

(10) Patent No.: US 6,758,643 B1
(45) Date of Patent: Jul. 6, 2004

(54) POSITIONING ASSEMBLY FOR POSITIONING A CONTAINER ON A PLATFORM

(76) Inventor: David Hsieh, 3F, No. 2, Chin-Chung St., Taichung City (TW)

( * ) Notice: Subject to any disclaimer, the term of this patent is extended or adjusted under 35 U.S.C. 154(b) by 0 days.

(21) Appl. No.: 10/646,061

(22) Filed: Aug. 22, 2003

(30) Foreign Application Priority Data

Jun. 30, 2003 (TW) ..... 092211980 U

(51) Int. Cl.[7] ..... B60P 7/08

(52) U.S. Cl. ..... 410/85; 410/77; 410/100; 410/96

(58) Field of Search ..... 410/77, 80, 81, 410/85, 96, 97, 100; 248/499; 114/75; 24/265 CD

(56) References Cited

U.S. PATENT DOCUMENTS 1,974,686 A * 9/1934 Meyercord ..... 410/84
3,083,670 A * 4/1963 Harlander et al. ..... 410/85
4,096,816 A * 6/1978 Patterson et al. ..... 114/75
4,249,840 A * 2/1981 Kallaes et al. ..... 410/84
4,537,539 A * 8/1985 Borchardt ..... 410/77
4,732,516 A * 3/1988 Borchardt ..... 410/77
6,666,633 B2 * 12/2003 Hsieh ..... 410/85
6,666,634 B1 * 12/2003 Hsieh ..... 410/85
6,669,417 B2 * 12/2003 Hsieh ..... 410/85

* cited by examiner

*Primary Examiner*—Stephen Gordon
(74) *Attorney, Agent, or Firm*—Christie, Parker & Hale, LLP

(57) ABSTRACT

A positioning assembly includes a first connecting rod with a threaded end section, a second connecting rod with a threaded end section, an adjusting member having two opposite threaded ends that threadedly engage the threaded end sections of the first and second connecting rods, and a third connecting rod that is pivoted to the second connecting rod so as to pivot relative to the second connecting rod between used and folded states.

4 Claims, 7 Drawing Sheets

POSITIONING ASSEMBLY FOR POSITIONING A CONTAINER ON A PLATFORM

CROSS-REFERENCE TO RELATED APPLICATION

This application claims priority of Taiwanese Application No. 092211980, filed on Jun. 30, 2003.

BACKGROUND OF THE INVENTION

1. Field of the Invention

This invention relates to a positioning assembly for positioning a container on a platform of a vehicle.

2. Description of the Related Art

FIGS. 1 and 2 illustrate conventional horizontal positioning assemblies 13 for positioning containers 14 on a platform 10 of a vehicle, such as a cargo-carrying ship. Each of the horizontal positioning assemblies 13 includes an adjusting member 131 connected to a support 11 on the platform 10 through a coupling member 132, and an extension rod 133 that threadedly engages the adjusting member 131 and that is connected to a corner fitting 141 of the respective container 14 through a hook member 134.

The conventional horizontal positioning assembly 13, when left on the platform 10 (i.e., it remains connected to the support 11), tends to be damaged during piling of the containers 14 on the platform 10. As a consequence, each positioning assembly 13 is normally required to be detached from the support 11, which is relatively inconvenient, and requires a space for storage. Moreover, since each positioning assembly 13 is relatively long, carrying and transport thereof for storage can be very troublesome.

SUMMARY OF THE INVENTION

Therefore, the object of the present invention is to provide a positioning assembly that is capable of overcoming the aforesaid drawbacks of the prior art.

According to the present invention, there is provided a positioning assembly for positioning a container on a platform. The container has a corner fitting. The positioning assembly comprises: a first connecting rod having a platform-connecting end that is adapted to be connected to the platform, and a threaded end section that is opposite to the platform-connecting end; a second connecting rod having a coupling end and a threaded end section that is opposite to the coupling end; an elongated adjusting member disposed between the first and second connecting rods and having two opposite threaded ends that threadedly and respectively engage the threaded end sections of the first and second connecting rods so as to permit extension and retraction of the first and second connecting rods relative to the adjusting member; a third connecting rod that has a hook-connecting end, and a pivot end opposite to the hook-connecting end and pivoted to the coupling end of the second connecting rod; and a hook member pivoted to the hook-connecting end of the third connecting rod and adapted to be connected to the corner fitting of the container.

BRIEF DESCRIPTION OF THE DRAWINGS

In drawings which illustrate an embodiment of the invention.

DETAILED DESCRIPTION OF THE PREFERRED EMBODIMENT

Figure 1:
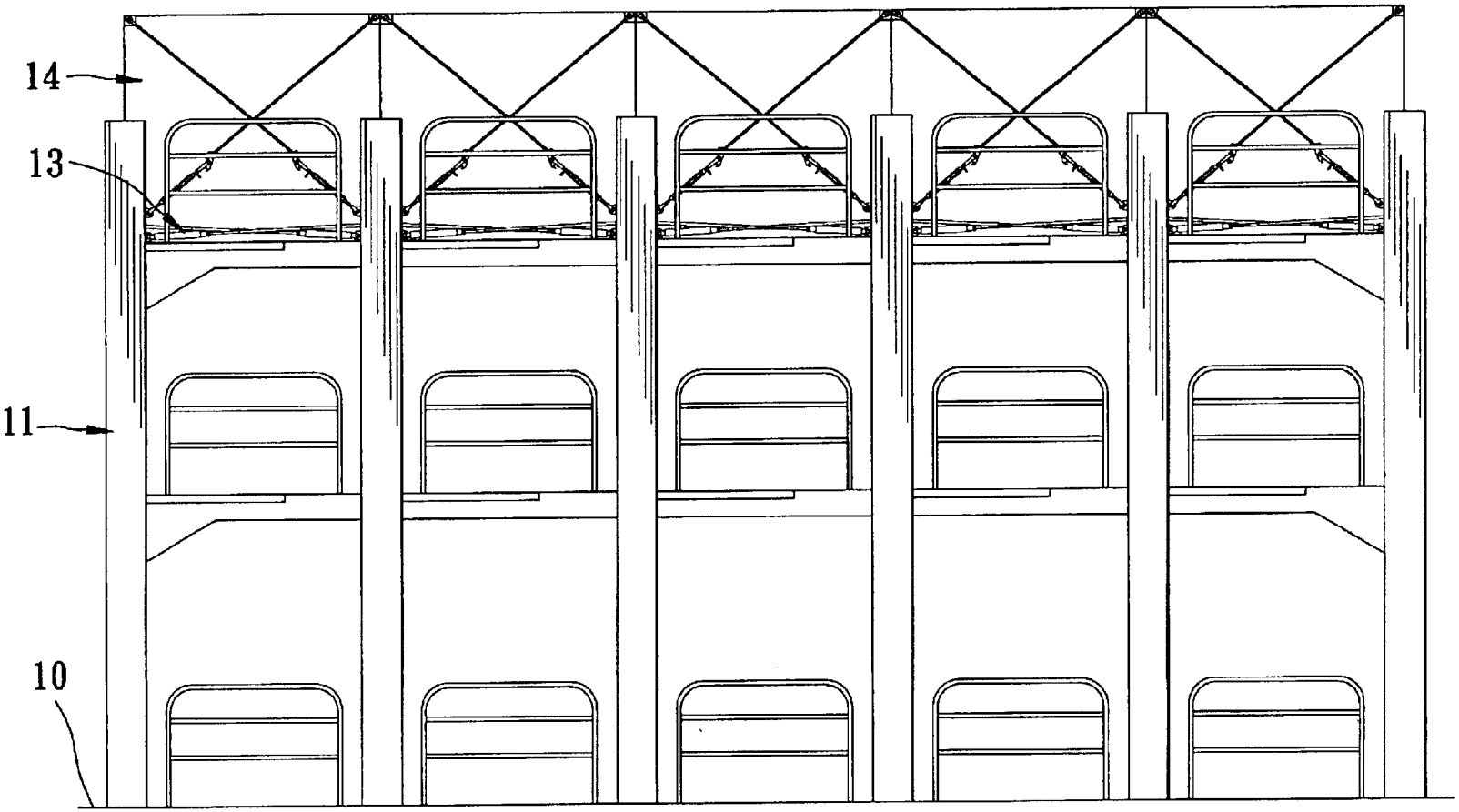
FIG. 1 PRIOR ART
FIG. 1 is a schematic side view to illustrate how conventional horizontal positioning assemblies are connected to corner fittings of containers on a platform.
Figure 2:
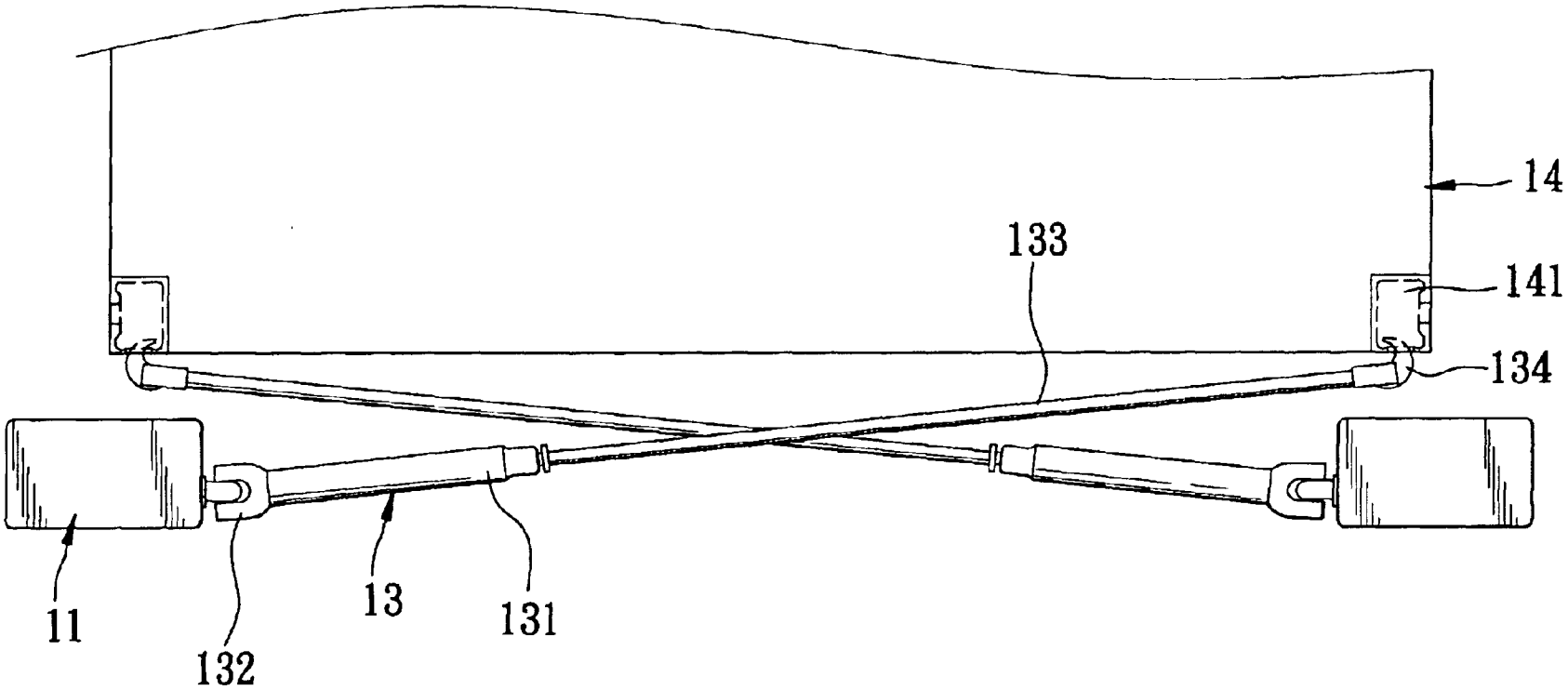
FIG. 2 PRIOR ART
FIG. 2 is a schematic fragmentary side view of one of the positioning assemblies of FIG. 1.
Figure 3:
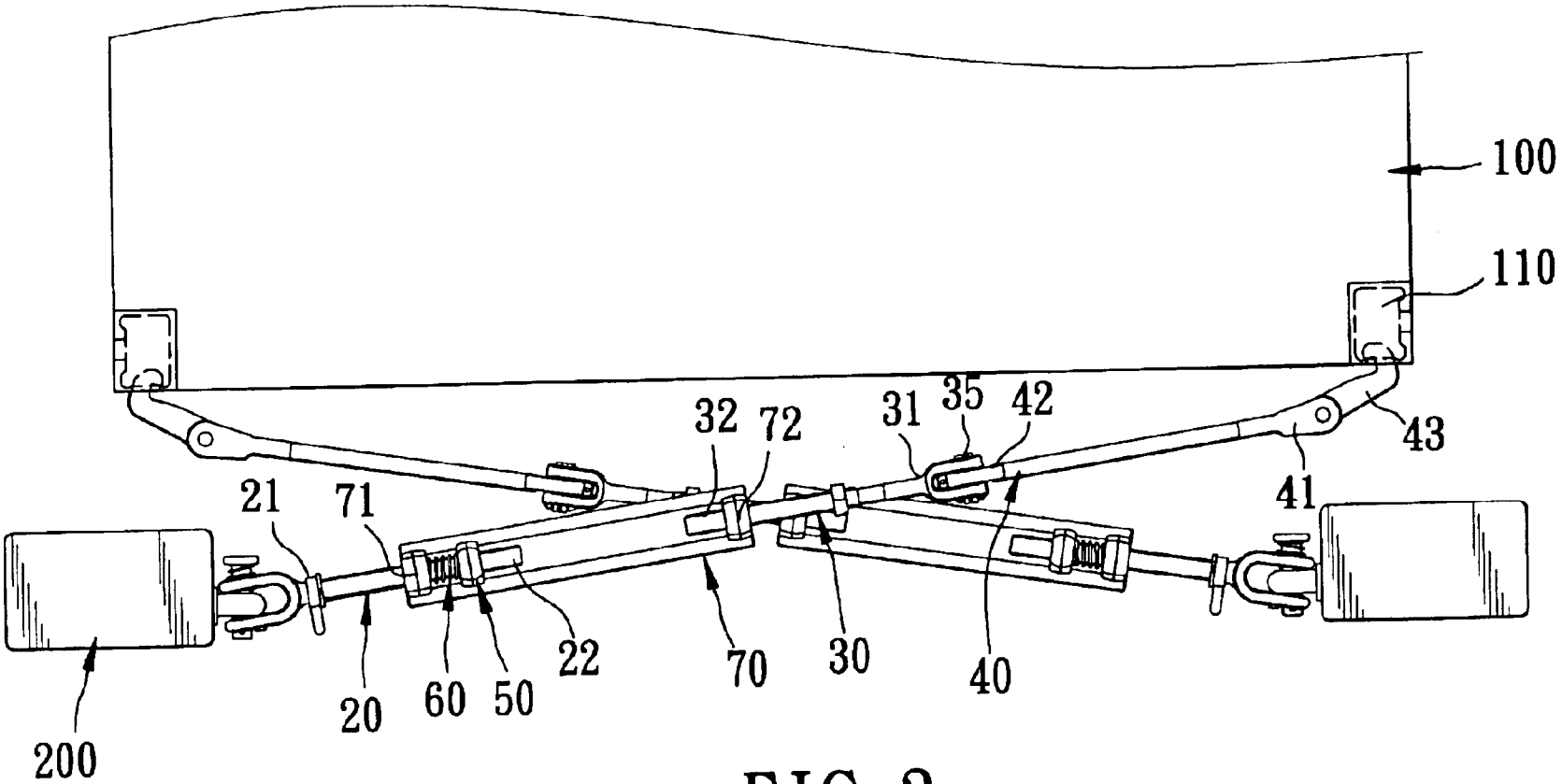
FIG. 3 is a schematic fragmentary side view of a preferred embodiment of a horizontal positioning assembly according to the present invention.

FIGS. 3 to 7 illustrate the preferred embodiment of a horizontal positioning assembly of this invention for positioning a container 100 on a platform (not shown) of a vehicle, such as a cargo-carrying ship. The container 100 has a corner fitting 110.

The horizontal positioning assembly includes: a first connecting rod 20 having a platform-connecting end 21 that is adapted to be connected to a support 200 on the platform, and a threaded end section 22 that is opposite to the platform-connecting end 21; a second connecting rod 30 having a coupling end 31 and a threaded end section 32 that is opposite to the coupling end 31; an elongated adjusting member 70 disposed between the first and second connecting rods 20, 30 and having two opposite threaded ends 71, 72 that threadedly and respectively engage the threaded end sections 22, 32 of the first and second connecting rods 20, 30 so as to permit extension and retraction of the first and second connecting rods 20, 30 relative to the adjusting member 70; a third connecting rod 40 that has a hook-connecting end 41, and a pivot end 42 opposite to the hook-connecting end 41 and pivoted to the coupling end 31 of the second connecting rod 30; and a hook member 43 pivoted to the hook-connecting end 41 of the third connecting rod 40 and adapted to be connected to the corner fitting 110 of the container 100.

The pivot end 42 of the third connecting rod 40 is pivoted to the coupling end 31 of the second connecting rod 30 through a pivot pin 35. The coupling end 31 of the second connecting rod 30 is U-shaped so as to define a recess 33 therein, and is formed with a first protrusion 312 (see FIG. 7) that protrudes therefrom into the recess 33 and that abuts against the third connecting rod 40 when the third connecting rod 40 is pivoted about the pivot pin 35 in a clockwise direction from an extended state (see FIG. 4), in which the second and third connecting rods 30, 40 extend along a line and in which the first protrusion 312 is disconnected from the third connecting rod 40, to a folded state (see FIGS. 5 and 6), in which the third connecting rod 40 is angled away from the second connecting rod 30 to a predetermined extent.

The coupling end 31 of the second connecting rod 30 is formed with a shoulder 313 (see FIGS. 6 and 7) that projects therefrom into the recess 33. The pivot end 42 of the third connecting rod 40 is received in the recess 33, and is formed with a second protrusion 421 that protrudes outwardly therefrom and that engages the shoulder 313 (see FIG. 7) when the third connecting rod 40 is pivoted about the pivot pin 35 in a counterclockwise direction, thereby limiting pivoting movement of the third connecting rod 40 in the counterclockwise direction.

Figure 4:
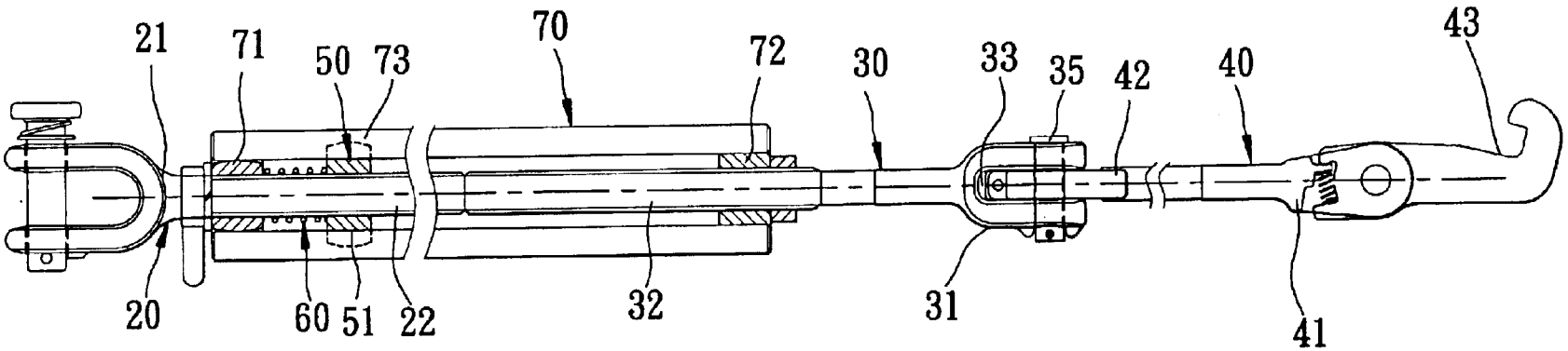
FIG. 4 is a partly sectional, schematic side view of the positioning assembly of FIG. 3, which is disposed at an extended state.

Referring further to FIG. 4, the adjusting member 70 includes a pair of parallel supporting rods 73, each of which has two opposite ends. Each of the threaded ends 71, 72 of the adjusting member 70 interconnects an adjacent pair of the ends of the supporting rods 73. A spring-confining member 50 is in the form of a nut member which threadedly engages the threaded end section 22 of the first connecting rod 20, and is formed with two opposite grooves 51 that slidingly and fittingly receive the supporting rods 73, respectively. A compression spring 60 is disposed between and abuts against the spring-confining member 50 and an adjacent one of the threaded ends 71 of the adjusting member 70 so as to prevent loosening of first connecting rod 20 relative to the adjusting member 70.

Figure 5:
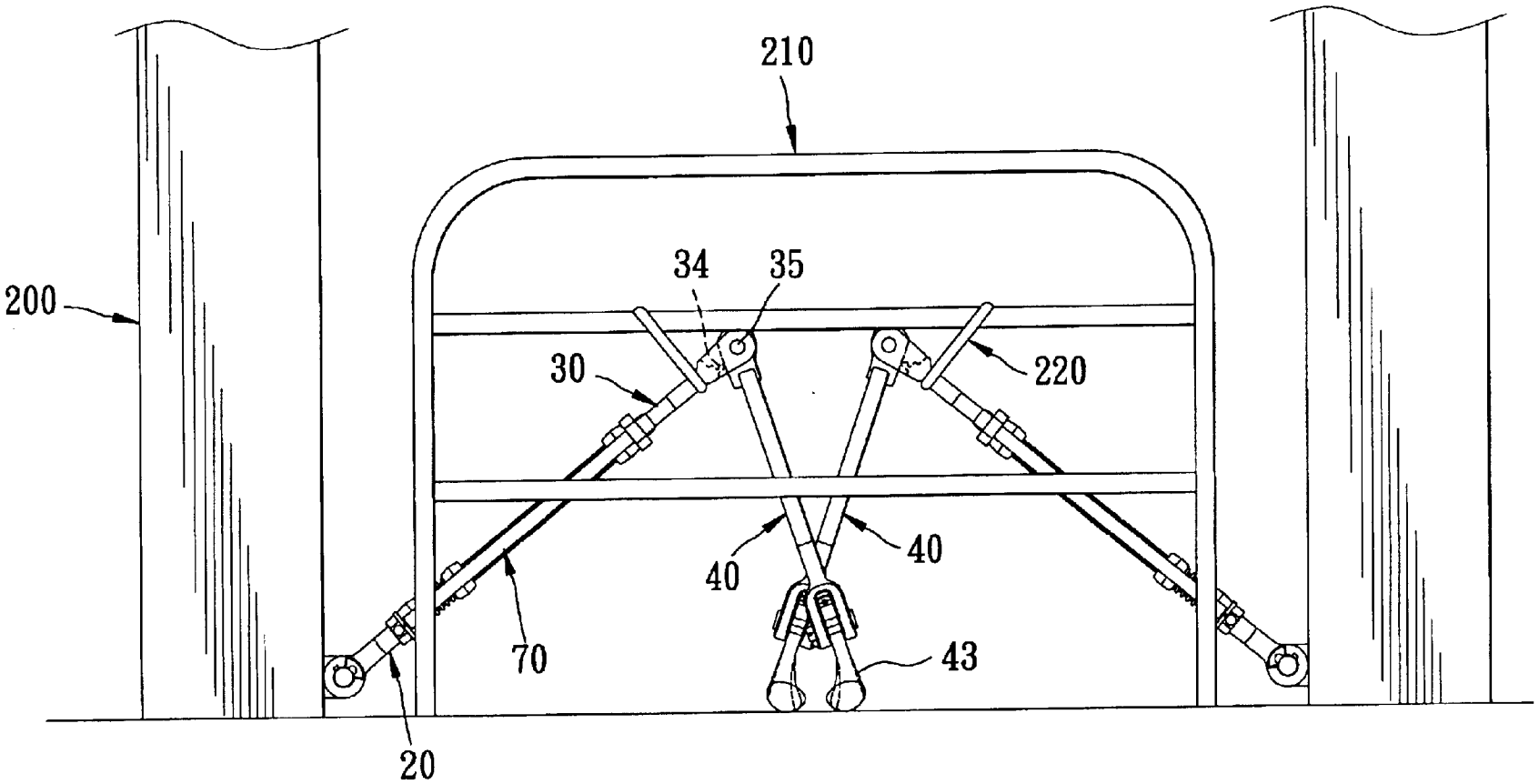
FIG. 5 is a fragmentary schematic side view of the positioning assembly of FIG. 3, which is disposed at a folded state.
Figure 6:
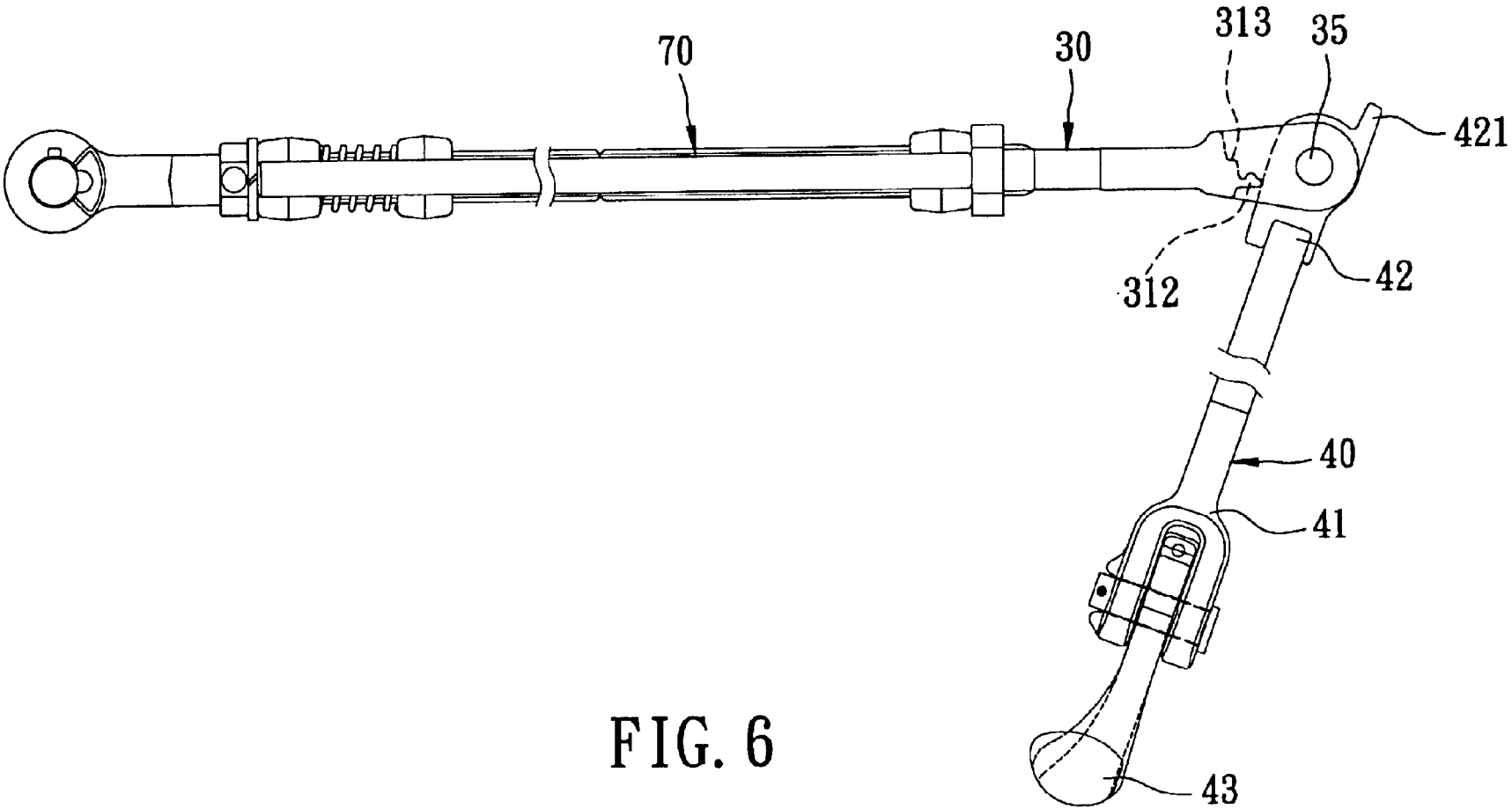
FIG. 6 is an enlarged schematic side view of the horizontal positioning assembly of FIG. 3, which is disposed at the folded state.
Figure 7:
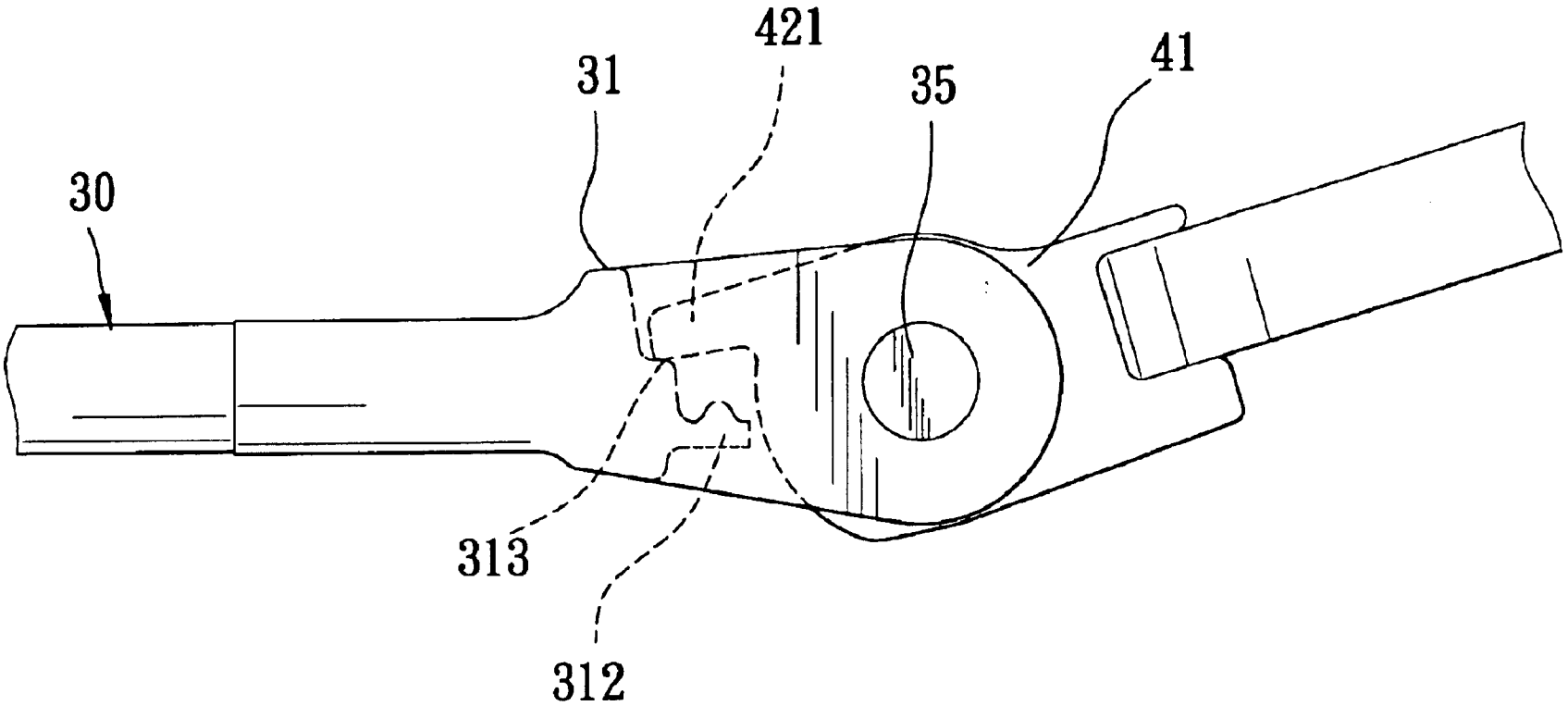
FIG. 7 is a fragmentary schematic side view to illustrate how a third connecting rod engages a second connecting rod when the third connecting rod rotates relative to the second connecting rod in a counterclockwise direction.

Referring further to FIG. 5, a binding member 220 is used to secure the positioning assembly to a fence 210 on the platform so as to prevent undesired movement of the positioning assembly when the positioning assembly is not in use.

With the third connecting rod 40 pivoted to the second connecting rod 30, the aforesaid drawbacks associated with the prior art can be eliminated.

With the invention thus explained, it is apparent that various modifications and variations can be made without departing from the spirit of the present invention. It is therefore intended that the invention be limited only as recited in the appended claims.

I claim:

1. A positioning assembly for positioning a container on a platform, the container having a corner fitting, said positioning assembly comprising:

a first connecting rod having a platform-connecting end that is adapted to be connected to the platform, and a threaded end section that is opposite to said platform-connecting end;

a second connecting rod having a coupling end and a threaded end section that is opposite to said coupling end;

an elongated adjusting member disposed between said first and second connecting rods and having two opposite threaded ends that threadedly and respectively engage said threaded end sections of said first and second connecting rods so as to permit extension and retraction of said first and second connecting rods relative to said adjusting member;

a third connecting rod that has a hook-connecting end, and a pivot end opposite to said hook-connecting end and pivoted to said coupling end of said second connecting rod; and a hook member pivoted to said hook-connecting end of said third connecting rod and adapted to be connected to the corner fitting of the container.

2. The positioning assembly of claim 1, further comprising a pivot pin, said pivot end of said third connecting rod being pivoted to said coupling end of said second connecting rod through said pivot pin, said coupling end of said second connecting rod being U-shaped so as to define a recess therein, and being formed with a first protrusion that protrudes therefrom into said recess and that abuts against said third connecting rod when said third connecting rod is pivoted about said pivot pin in a clockwise direction from an extended state, in which said second and third connecting rods extend along a line and in which said first protrusion is disconnected from said third connecting rod, to a folded state, in which said third connecting rod is angled away from said second connecting rod to a predetermined extent.

3. The positioning assembly of claim 2, wherein said coupling end of said second connecting rod is formed with a shoulder that projects therefrom into said recess, said pivot end of said third connecting rod being received in said recess and being formed with a second protrusion that protrudes outwardly therefrom and that engages said shoulder when said third connecting rod is pivoted about said pivot pin in a counterclockwise direction, thereby limiting pivoting movement of said third connecting rod in said counterclockwise direction.

4. The positioning assembly of claim 3, wherein said adjusting member includes a pair of parallel supporting rods, each of which has two opposite ends, each of said threaded ends of said adjusting member interconnecting an adjacent pair of said ends of said supporting rods, said positioning assembly further comprising a spring-confining member that is in the form of a nut member which threadedly engages said threaded end section of said first connecting rod and which is formed with two opposite grooves that slidingly and fittingly receive said supporting rods, respectively, said positioning assembly further comprising a compression spring that is disposed between and that abuts against said spring-confining member and an adjacent one of said threaded ends of said adjusting member.

* * * * *